US006674011B2

(12) United States Patent
Ueno et al.

(10) Patent No.: US 6,674,011 B2
(45) Date of Patent: Jan. 6, 2004

(54) STRANDED CONDUCTOR TO BE USED FOR MOVABLE MEMBER AND CABLE USING SAME

(75) Inventors: Satoshi Ueno, Ibaraki (JP); Hiroo Tanaka, Ibaraki (JP); Hakaru Matsui, Ibaraki (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

(21) Appl. No.: 09/912,405

(22) Filed: Jul. 25, 2001

(65) Prior Publication Data

US 2003/0037957 A1 Feb. 27, 2003

(30) Foreign Application Priority Data

May 25, 2001 (JP) ..... 2001-157390

(51) Int. Cl.[7] ..... H01B 5/08
(52) U.S. Cl. ..... 174/128.1
(58) Field of Search ..... 174/36, 113 R, 174/120 R, 126.1, 128.1, 128.2

(56) References Cited

U.S. PATENT DOCUMENTS

| | | | | | |
|---|---|---|---|---|---|
| 1,904,116 | A | * | 4/1933 | Baum | 174/128.1 |
| 2,778,870 | A | * | 1/1957 | Nolan | 174/128.1 |
| 3,075,344 | A | * | 1/1963 | Fenner et al. | 57/216 |
| 3,131,469 | A | * | 5/1964 | Glaze | 228/136 |
| 3,231,665 | A | * | 1/1966 | Grimes, Jr. et al. | 174/108 |
| 3,339,012 | A | * | 8/1967 | Hutchins, Jr. | 174/128.1 |
| 3,647,939 | A | * | 3/1972 | Schoerner | 174/128.1 |
| 3,926,573 | A | * | 12/1975 | Sexton | 428/652 |
| 4,039,743 | A | * | 8/1977 | Gommans | 174/114 R |
| 4,078,299 | A | * | 3/1978 | Furuto et al. | 29/599 |
| 4,279,967 | A | * | 7/1981 | Sawada | 428/647 |
| 4,594,116 | A | * | 6/1986 | Inagaki | 148/536 |
| 4,727,002 | A | * | 2/1988 | Inagaki | 420/485 |
| 4,734,545 | A | * | 3/1988 | Susuki et al. | 174/120 SR |
| 4,755,235 | A | * | 7/1988 | Matidori et al. | 148/682 |
| 4,838,959 | A | * | 6/1989 | Inagaki | 148/685 |
| 4,965,245 | A | * | 10/1990 | Sugimoto et al. | 505/431 |
| 5,012,045 | A | * | 4/1991 | Sato | 174/106 R |
| 5,024,814 | A | * | 6/1991 | Futatasuka et al. | 420/473 |
| 5,170,015 | A | * | 12/1992 | Kudo et al. | 174/119 R |
| 5,216,205 | A | * | 6/1993 | Fujii et al. | 174/128.1 |
| 5,558,794 | A | * | 9/1996 | Jansens | 174/108 |
| 6,053,994 | A | * | 4/2000 | Saleh et al. | 148/432 |
| 6,103,976 | A | * | 8/2000 | Kobayashi et al. | 174/113 R |
| 6,204,452 | B1 | * | 3/2001 | Valadez et al. | 174/126.1 |
| 6,303,868 | B1 | * | 10/2001 | Kawai | 174/128.1 |
| 6,399,886 | B1 | * | 6/2002 | Avellanet | 174/128.1 |

FOREIGN PATENT DOCUMENTS

| | | | | |
|---|---|---|---|---|
| JP | 54-129379 | A | * 10/1979 | H01B/5/08 |
| JP | 01-147032 | A | * 8/1989 | H01B/1/02 |
| JP | 02-123617 | A | * 5/1990 | H01B/5/08 |
| JP | 02-267811 | A | * 11/1990 | H01B/5/02 |
| JP | 02-270212 | A | * 11/1990 | H01B/5/08 |
| JP | 02-273417 | A | * 11/1990 | H01B/12/16 |
| JP | 02-278608 | A | * 11/1990 | H01B/1/02 |
| JP | 04-209413 | A | * 7/1992 | H01B/5/02 |
| JP | 04-259343 | A | * 9/1992 | H01B/1/02 |
| JP | 3010906 | A | * 11/1993 | H01B/1/02 |
| JP | 05-311283 | A | * 11/1993 | H01B/5/02 |
| JP | 2000-251530 | A | * 9/2000 | H01B/5/08 |

OTHER PUBLICATIONS

C & M Corporation, Jan. 1992, Engineering Design Guide, (3rd Edition), p. 2.*

* cited by examiner

*Primary Examiner*—William H. Mayo, III
(74) *Attorney, Agent, or Firm*—Antonelli, Terry, Stout & Kraus, LLP

(57) ABSTRACT

A layered stranded conductor has an inner layer section and an outer layer section. The inner layer section has one or more inner section element wires, including a first element wire having an outer diameter of 0.08 mm or less. The outer layer section has one or more outer section element wires, including a second element wire stranded with the first element wire and an outer diameter of 0.08 mm or less. The first element wire has 1.5 times or higher tensile strength than that of a second element wire. Additionally, the one or more inner and the one or more outer section element wires are stranded with each other such that a ratio of a strength of the one or more inner section wires to a strength of the one or more outer section wires is 0.5 to 5.

16 Claims, 3 Drawing Sheets

STRANDED CONDUCTOR TO BE USED FOR MOVABLE MEMBER AND CABLE USING SAME

BACKGROUND OF THE INVENTION

1. Field of the Invention

The present invention relates to a stranded conductor to be used for movable member and a cable using the same, and particularly to a stranded conductor to be used for movable member, for which high strength, high flexing properties, and high conductivity are required as well as to a cable using the stranded conductor to be used for movable member.

2. Description of Related Art

In recent years, a cable used as a wiring material for movable member such as medical instruments, industrial robots, and electronic equipment such as notebook-size personal computer and the like, for instance, a cable used for medical equipment is applied under an atmosphere where an external force produced by combining severe bending, twisting, tensile and the like forces with each other is loaded repeatedly in medical field. For this reason, such a cable conductor is required to have excellent characteristics in tensile property (tensile strength) and flexing properties (elasticity, and torsibility).

Furthermore, it is intended to make a diameter of a conductor more slender with respect to a request or a demand for downsizing and weight reduction of electronic equipment and the like. However, tensile properties and flexing properties decrease with decrease in a diameter of a conductor. Thus, there is a fear of arising breaking of wire in an early stage during use of equipment due to buckling, fatigue and the like.

Moreover, since a frequency of transmission signal is in a GHz level with increase in an amount of information to be transmitted with respect to a cable conductor used in electronic equipment and the like, transmission characteristics in a high-frequency band (hereinafter referred to as "high-frequency properties") are considered to be important.

In order to cope with such request and demand as described above, the following cable conductors have been developed. (1) A cable conductor prepared from a copper alloy material wherein Sn, Ag or the like is added to copper, whereby tensile properties and flexing properties thereof have been elevated. (2) A cable conductor prepared by incorporating stainless wires or fibrous interposition inside a strand made from a high conductive copper material such as soft copper (this means herein a generic term for a copper material prepared from electrolytic copper, deoxidized copper, oxygen free copper or the like) as a tension member. (3) A cable conductor prepared by disposing an element wire having a high strength on the outer layer of a strand made from a high conductive copper material such as soft copper.

In a conductive material constituting a cable conductor, antithetical characteristics are required. Namely, good conductivity (high conductivity) as well as good tensile and flexing properties are demanded at the same time. In this respect, however, although tensile and flexing properties can be improved by increasing an amount of an additive to be added to copper in the cable conductor (1), there has been a problem of lowering conductivity with increase of the additive. In this case, it is possible to control tensile properties and conductivity within a range of a certain degree by adjusting an amount of an additive. However, when elevation of flexing properties is intended, it results in remarkable reduction in conductivity. Hence, there has been a problem of giving rise to reduction of high-frequency properties.

Furthermore, it is an important factor that a connecting section of a cable conductor has such a conductor structure, which is compact, connection of which is easy, and reliability in connection is high with a trend toward downsizing of electronic equipment and the like. In this respect, there have been problems of reduction of workability in stranding operation, remarkable reduction of conductivity, and reduction of terminal processability (connecting properties in case of processing a terminal by means of soldering, contact-bonding or the like operation) with respect to the cable conductor (2), when it was formed into an extra fine wire having an outer diameter of 0.08 mm or less.

Moreover, the cable conductor (3) is comparatively excellent in flexing properties, while there has been such problem that high-frequency properties are not good.

SUMMARY OF THE INVENTION

In view of the circumstances as described above, an object of the present invention is to provide a stranded conductor to be used for movable member having good stranding workability and terminal processability as well as having good conductivity, tensile properties, flexing properties, and high-frequency properties, and to provide a cable using the above-described stranded conductor.

In order to achieve the above-described object, a stranded conductor to be used for movable member according to the present invention prepared by stranding two or more types of element wires with each other, each type having different mechanical properties from one another, and having a two-layered structure of an inner layer section and an outer layer section, comprises a first element wire constituting at least the inner layer section having 1.5 times or higher tensile strength than that of a second element wire constituting at least a part of the outer layer section; and the respective element wires being stranded with each other in such that a ratio of a strength in a group of inner layer element wires forming the inner layer section to a strength in a group of outer layer element wires forming the outer layer section (a tensile strength in the group of inner layer element wires/a tensile strength in the group of outer layer element wires) comes to be 0.5 to 5.

Furthermore, a stranded conductor to be used for movable member according to the present invention prepared by stranding two or more types of element wires with each other, each type having different mechanical properties from one another, and having a two-layered structure of an inner layer section and an outer layer section, comprises a first element wire made from a rigid copper alloy wire having 1000 MPa or higher tensile strength and 0.2% or higher elongation, which constitutes at least the inner layer section; a second element wire made from a soft or a semi-rigid copper alloy wire having 70% or higher IACS and 5% or higher elongation, which constitutes at least a part of the outer layer section; and the respective element wires being stranded with each other in such that a ratio of a strength in a group of inner layer element wires forming the inner layer section to a strength in a group of outer layer element wires forming the outer layer section (a tensile strength in the group of inner layer element wires/a tensile strength in the group of outer layer element wires) comes to be 0.5 to 5.

According to the above-described constitutions of the present invention, since second element wires each having high elongation are disposed for an outer layer section having the highest amount of strain, and a first element wire(s) is (are) arranged for an inner layer section to which the highest tensile stress is to be loaded, good tensile properties are obtained, besides a remarkable improvement in flexing properties can be intended. Moreover, since the second element wires constituting the outer layer section exhibit high conductivity, high frequency properties of the resulting stranded conductor become good.

On one hand, a cable using a stranded conductor to be used for movable member according to the present invention comprises an insulating layer being disposed around the outer circumference of the above-mentioned stranded conductor to be used for movable member.

According to the above-described constitution of the present invention, a cable having good stranding workability and good terminal processability as well as having good conductivity, tensile properties, flexing properties, and high-frequency properties can be obtained.

BRIEF DESCRIPTION OF THE DRAWINGS

The present invention will be explained in more detail in conjunction with appended drawings, wherein:

FIG. 1(*b*) is a view in the direction of the arrow 1*b* in FIG. 1(*a*);

DESCRIPTION OF THE PREFERRED EMBODIMENTS

Preferred embodiments of the present invention will be described hereinafter in conjunction with the accompanying drawings.

Figure 1A:
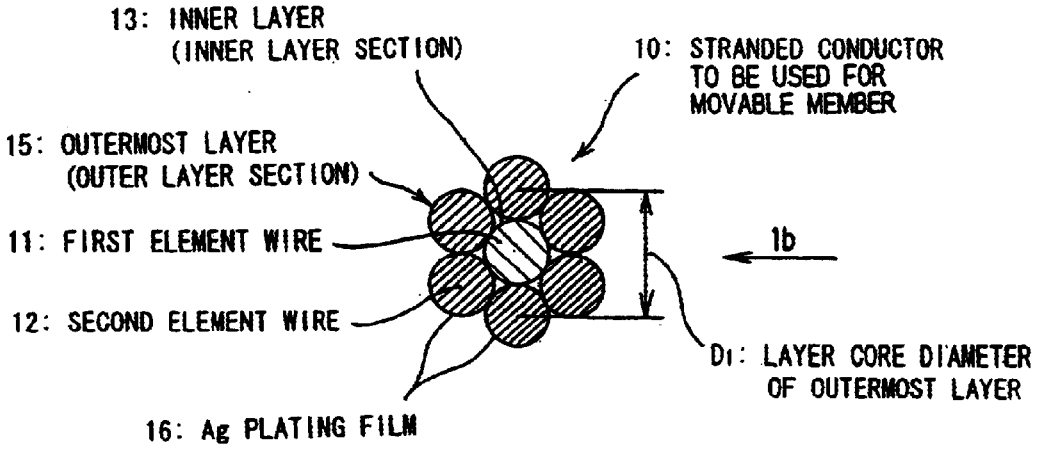
FIG. 1(*a*) is a cross-sectional view showing a stranded conductor to be used for movable member according to a first embodiment of the present invention.
Figure 1B:
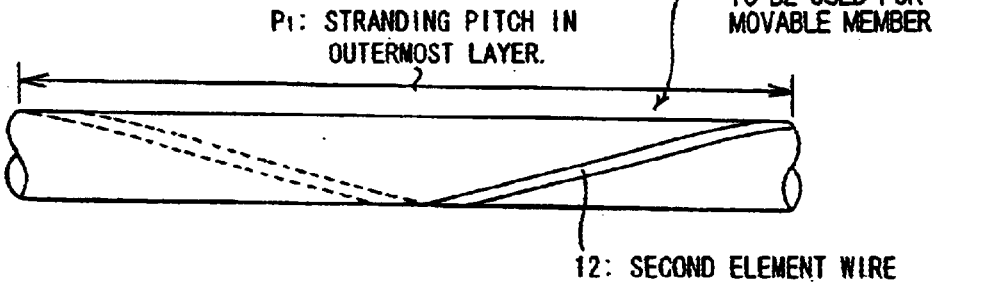

FIGS. 1(*a*) and 1(*b*) are views each showing a stranded conductor to be used for movable member according to the first embodiment of the present invention wherein FIG. 1(*a*) is a cross-sectional view, and FIG. 1(*b*) is a view in the direction of the arrow 1*b* in FIG. 1(*a*).

As shown in FIGS. 1(*a*) and 1(*b*), a stranded conductor to be used formovable member (cable conductor) 10 according to the first embodiment is prepared by stranding two types of element wires 11 and 12 having different mechanical characteristics from one another. The resulting stranded conductor has a two-layered structure of an inner layer (inner layer section) 13 and the outermost layer (outer layer section) 15. More specifically, the stranded conductor to be used for movable member has a two-layered structure prepared by stranding a plurality of second element wires 12 (six wires in FIG. 1(*a*)) around the outer circumference of at least one (one wire in FIG. 1(*a*)) of the first element wire 11 to form the outermost layer 15.

In this case, stranding of the second element wires 12 upon the first element wire 11 is made to be in such that a ratio of a stranding pitch $P_1$ in the outermost layer 15 to a layer core diameter (diameter of a layer core section) $D_1$ of the outermost layer 15 is within a range of from 7 to 25, whereby a ratio ($T_{IN}/T_{OUT}$(tensile strength in the group of inner layer element wires/tensile strength in the group of the outer layer element wires)) of intensity ($T_{IN}$) of the first element wire (a group of inner layer element wires) 11 composing the inner layer 13 to intensity ($T_{OUT}$) of all the second element wires (a group of outer layer element wires) 12 composing the outermost layer 15 is to be obtained within a range of from 0.5 to 5. The layer core diameter $D_1$ of the outermost layer 15 is the same as a diameter of a circle formed by tracing wire cores of the respective second element wires 12.

The first element wire 11 has a tensile strength of 1.5 or more times higher than that of the second element wire 12. More specifically, the first element wire 11 is prepared from rigid copper alloy wires each having 1000 MPa or higher tensile strength, and 0.2% or higher elongation, while the second element wire 12 is prepared from soft or semi-rigid copper alloy wires each having a conductivity of 70% or higher IACS, preferably 90% or higher IACS, and more preferably 95% or higher IACS, and an elongation of 5% or higher, preferably 10% or higher, and more preferably 15% or higher. An example of rigid copper alloy includes a fiber-reinforced type copper alloy containing 2 to 10 wt % of Ag or Nb. An example of soft or semi-rigid alloy includes soft copper, and Sn-containing copper alloy wherein a total amount of an additive is 0.5 wt % or less.

On the outer circumferences of all the element wires involving the first element wire 11 and the second element wires 12, an Ag plating film 16 having 0.6 $\mu$m or thicker film thickness is formed.

An outer diameter of the second element wire 12 is formed into equal to or a smaller size than that of an outer diameter of the first element wire 11 (both the first and second element wires have an equal diameter in case of FIG. 1(*a*)).

While sizes of outer diameters of the respective element wires 11 and 12 are not specifically restricted, it is preferred that each of these elements wires is an extra fine wire having 0.08 mm or less diameter with taking a cost for material of the stranded conductor 10 into consideration in view of such fact that Ag is used for the element wire 11 itself as well as for a plating film formed on the outer circumferences of the element wires 11 and 12.

In the following, operations of the present invention will be described.

In the first preferred embodiment, an element wire 11 prepared from a copper material having high strength is used as an inner layer 13, and element wires 12 each prepared from a copper material having high elongation and high conductivity are disposed as the outermost layer 15. The reason why such an alignment as described above has been adopted is based on the following result analyzed. Namely, stress applied to a stranded conductor 10 was analyzed in the case when an external force such as flexing force, and twisting force is applied to the stranded conductor 10. As a result, it was found that the whole elongation was remarkably concerned with bending in plastic zone, and the whole tensile properties were significantly concerned with flexing properties (flex life) with respect to bending in elastic region in case of simple flexing wherein the stranded conductor 10 is flexed from side to side (in a breadth direction), while it was also found that elongation in a surface of the stranded conductor 10 was a factor for deciding flexing properties in case of twisting. Thus, in the stranded conductor 10 which has been prepared by stranding two or more types of element wires 11 and 12 having different mechanical properties from one another, and having a two-layered structure of the inner layer 13 and the outermost layer 15, the second element wires 12 each having high elongation are arranged as the outermost layer 15 to which the largest amount of strain is to be applied, while the first element wire 11 having high strength is disposed for the inner layer 13 to which the largest tensile stress is to be loaded. As a result, not only good tensile properties are obtained, but also remarkable improvements can be intended in flexing properties in accordance with a stranded conductor of the first embodiment.

Furthermore, in the first preferred embodiment, the stranded conductor has also a structure wherein the second element wires 12 each having high conductivity are arranged for the outermost layer 15. In a high frequency region, since a current distribution in the stranded conductor 10 becomes a higher density with getting closer to a surface layer (i.e., with getting closer to a side of an outer layer) due to skin effect, it becomes possible to more efficiently transfer high frequency at lower loss because of adoption of such structure as described above, whereby excellent high-frequency properties are exhibited.

Moreover, when the second element wires 12 are stranded around the outer circumference of the first element wire 11, they are arranged in such that a ratio of a stranding pitch $P_1$ in the outermost layer 15 to a layer core diameter $D_1$ in the outermost layer 15 ($P_1/D_1$) is within a range of from 7 to 25.

This is based on such a reason that when a stranding pitch $P_1$ is made to be small, strain to be applied to the element wires 12 disposed on the outside the first element wire 11 can be reduced in case of flexing and/or twisting a stranded conductor. However, when a stranding pitch $P_1$ is made to be too small, although it becomes advantageous for reducing strain (flexing properties) with respect to flexing and/or twisting, it results in reduction of stranding workability (productivity), and it turns to rising of cost. For this reason, a ratio of $P_1/D_1$is specified within a range of from 7 to 25 with taking a balance between flexing properties and stranding workability into consideration.

Besides, the reason why the Ag plating film 16 is formed on the outer circumferences of the respective element wires 11 and 12 is in that Ag exhibits a higher conductivity in comparison with the other metallic materials such as Sn, Ni, and Au, and further Ag is excellent in high-frequency properties as well as in cost performance. When the Ag plating film 16 is formed, core wire workability, stranding workability, and terminal processability become well, besides flexing properties are improved remarkably. On one hand, the reason why a plating film thickness is made to be 0.6 $\mu$m or thicker is in that terminal processability is better than a case where the plating film thickness is less than 0.6 $\mu$m.

As described above, according to the first preferred embodiment, a stranded conductor 10 to be used for movable member, which attains all of conductivity, tensile properties, flexing properties, and high-frequency properties at a high level, respectively, and which exhibits good stranding workability as well as good terminal processability can be obtained.

The other preferred embodiments of the present invention will be described hereinafter in conjunction with the accompanying drawings.

FIGS. 2 through 5 are cross-sectional views each showing a stranded conductor to be used for movable member according to each of second through fifth preferred embodiments of the present invention wherein the same components as those of FIGS. 1(*a*) and 1(*b*) are designated by the same reference characters in FIGS. 2 through 5, respectively.

Figure 2:
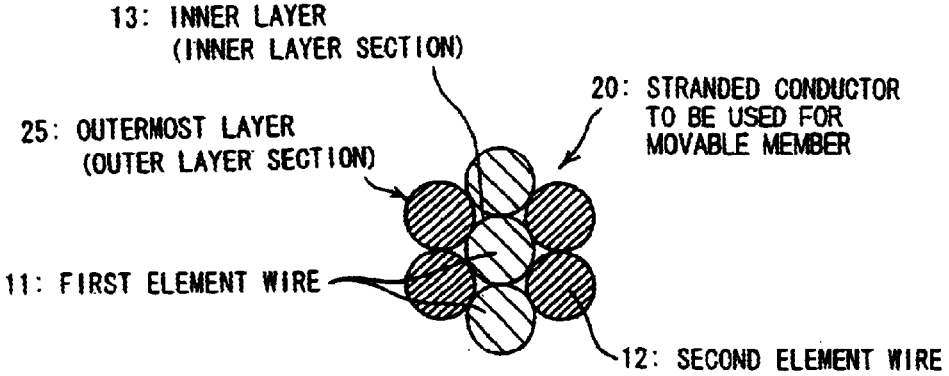
FIG. 2 is a cross-sectional view showing a stranded conductor to be used for movable member according to a second embodiment of the present invention.

In the above-mentioned first preferred embodiment, the outermost layer 15 has been composed of the second element wires 12 only. On the other hand, as shown in FIG. 2, a stranded conductor 20 to be used for movable member according to the second preferred embodiment has a two-layered structure wherein the outermost layer (outer layer section) 25 is prepared by stranding a plurality of first element wires 11 (two wires in FIG. 2) as well as a plurality of second element wires 12 (four wires in FIG. 2) around the outer circumference of a single first element wire 11 constituting an inner layer 13. In this case, the first element wires 11 in the outermost layer 25 are arranged so as to be each point symmetry centering around the wire center of the first element wire 11 forming the inner layer 13. Furthermore, each outer diameter of the first element wires 11 and the second element wires 12 constituting the outermost layer 25 is formed with an equal to or a less than the outer diameter (formed into an equal diameter in FIG. 2) of the first element wire constituting the inner layer 13. In addition, a group of the outer layer element wires is composed of the first element wire 11 and the second element wires 12 constituting the outermost layer 25.

Figure 3:
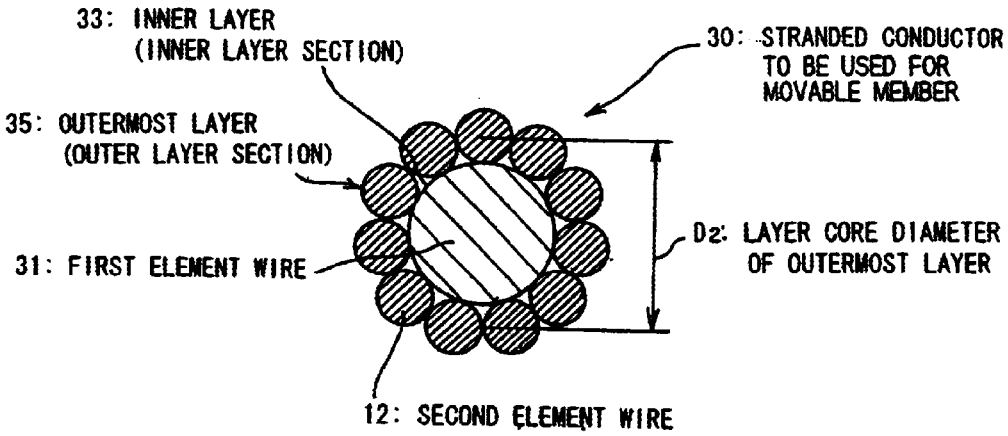
FIG. 3 is a cross-sectional view showing a stranded conductor to be used for movable member according to a third embodiment of the present invention.

In the aforementioned first preferred embodiment, the first element wire 11 and the second element wire 12 have been equal diameters to each other, while a stranded conductor 30 to be used for movable member according to the third preferred embodiment has a two-layered structure forming the outermost layer (outer layer section) 35 by stranding a plurality of the second element wires 12 (eleven wires in FIG. 3) each having a smaller diameter than that of a first element wire 31 around the outer circumference of the single first element wire 31 constituting an inner layer (inner layer section) 33 as shown in FIG. 3. A layer core diameter (diameter of layer core section) $D_2$ of the outermost layer 35 corresponds to a diameter of a circle defined by tracing respective wire centers of the second element wires 12.

Figure 4:
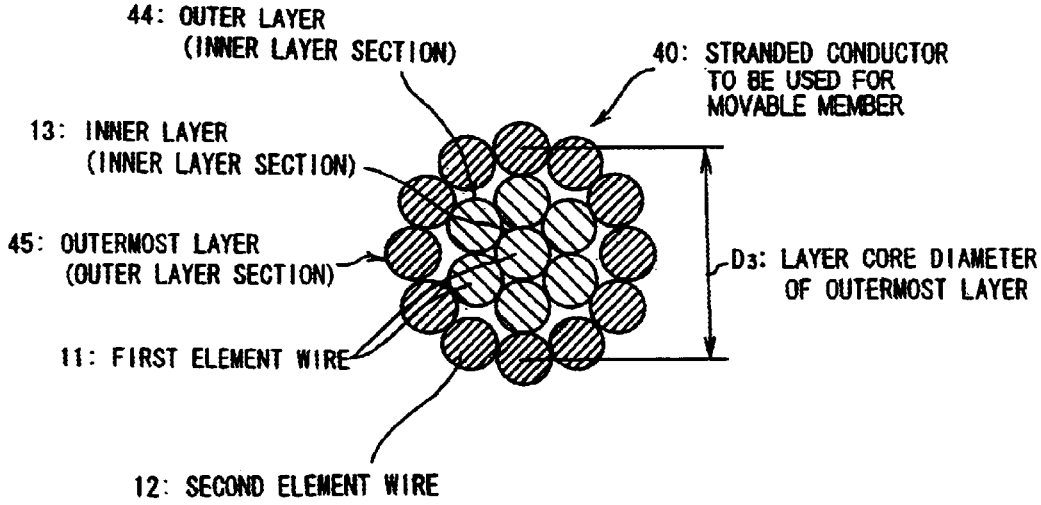
FIG. 4 is a cross-sectional view showing a stranded conductor to be used for movable member according to a fourth embodiment of the present invention.

Moreover, a stranded conductor has had a two-layered structure composed of the inner layer 13 and the outermost layer 15 in the aforementioned first preferred embodiment. On one hand, a stranded conductor 40 to be used for movable member according to a fourth preferred embodiment of the invention has a three-layered structure prepared by stranding a plurality of second element wires 12 (twelve wires in FIG. 4) around the outer circumference of an outer layer 44 to form the outermost layer (outer layer section) 45, and the outer layer (outer layer section) 45 being prepared by stranding a plurality of the first element wires 11 (six wires in FIG. 4) around a single first element wire 11 constituting an inner layer (inner layer section) 13 as shown in FIG. 4. In this case, a layer core diameter (diameter of layer core section) $D_3$ of the outermost layer 45 corresponds to a diameter of a circle defined by tracing respective wire centers of the second element wires 12. Further, a group of inner layer element wires is composed of the first element wires 11 constituting the inner layer (inner layer section) 13 and the outer layer 44.

Figure 5:
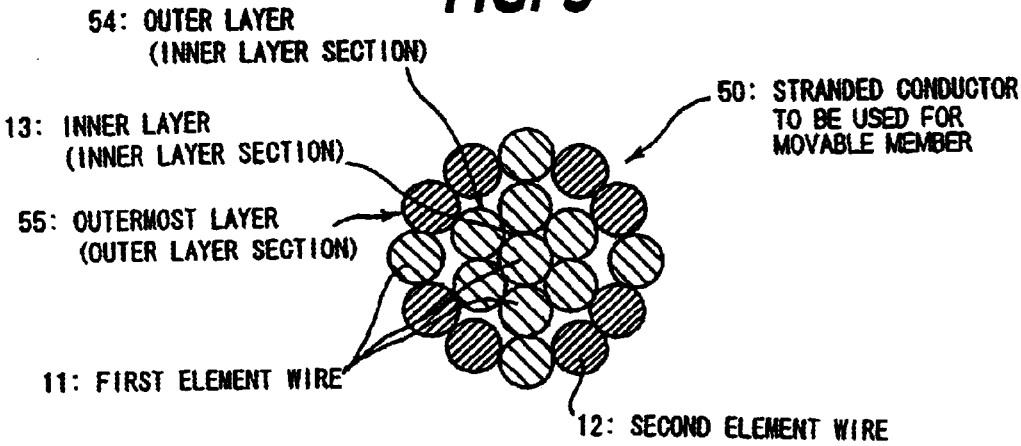
FIG. 5 is a cross-sectional view showing a stranded conductor to be used for movable member according to a fifth embodiment of the present invention.

Besides, the outermost layer 45 of a stranded conductor has been constituted from the second element wires 12 only in the aforementioned fourth embodiment. On the other hand, a stranded conductor 50 to be used for movable member according to a fifth embodiment of the invention has a three-layered structure prepared by stranding a plurality of first element wires 11 (four wires in FIG. 5) and a plurality of second element wires 12 (eight wires in FIG. 5) around the outer circumference of an outer layer 54 to form the outermost layer (outer layer section) 55, and the outer layer (inner layer section) 54 being prepared by stranding a plurality of the first element wires 11 (six wires in FIG. 5) around the outer circumference of a single first element wire 11 constituting an inner layer (inner layer section) 13 as shown in FIG. 5 In this case, the first element wires 11 in the outermost layer 55 are arranged so as to be each point symmetry centering around the wire center of the first element wire 11 forming the inner layer 13. Furthermore, each outer diameter of the first element wires 11 and the second element wires 12 constituting the outermost layer 55 is formed with an equal to or a less than each outer diameter (formed into an equal diameter in FIG. 5) of the first element wires 11 constituting the inner layer 13 and the outer layer 54. In addition, a group of inner layer element wires (inner layer section) is composed of the first element wires 11 constituting the inner layer 13 and the outer layer 54, while a group of outer layer element wires (outer layer section) is composed of the first element wires 11 and the second element wires 12 constituting the outermost layer 55.

As a matter of course, the same functions and advantages as those of the stranded conductor 10 according to the first embodiment are attained also in each of the stranded conductors 20 to 50 according to the second through the fifth preferred embodiments. On one hand, when the stranded conductors 20 and 50 according to the second and the fifth embodiments are compared with the stranded conductors 10 and 40 according to the first and the fourth embodiments, although conductivity, high-frequency properties, and flexing properties with respect to twisting decrease slightly in the former stranded conductors 20 and 50, there is an advantage of improving further their tensile properties.

Figure 6:
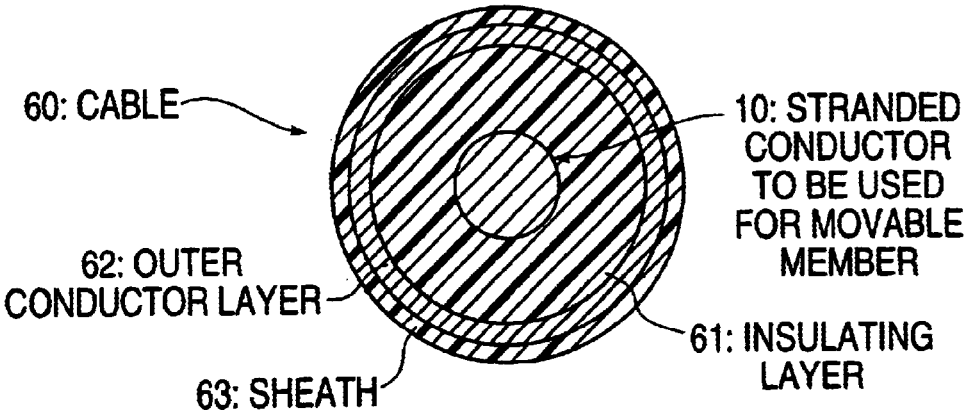
FIG. 6 is a cross-sectional view showing a cable using a stranded conductor to be used for movable member according to the present invention.

FIG. 6 is a cross-sectional view showing a cable using a stranded conductor to be used for movable member according to the present invention wherein the same component as that of FIG. 1 is designated by the same reference character as that in the same figure in also FIG. 6.

As shown in FIG. 6, a cable 60 using a stranded conductor to be used for movable member according to the present invention is prepared in such a manner that an insulating layer 61 is disposed on the outer circumference in each of the stranded conductors 10 to 50 shown in FIGS. 1 to 5 being an inner conductor (the stranded conductor 10 is shown in FIG. 6), an outer conductor 62 is disposed around the outer circumference of the insulating layer 61, and a sheath 63 is disposed around the outer circumference of the outer conductor 62.

The insulating layer 61 is disposed by means of extrusion coating of a resin or the like manner. An example of resin materials for forming the insulating material 61 includes PFA (Teflon) resin, polyethylene, polypropylene, ETFE (ethylene tetrafluoroethylene copolymer) resin, and FEP (fluoroethylene propylene) resin. Furthermore, the outer conductor 62 is prepared by metal-plating a stranded conductor 10, winding a plurality of element wires of a metal conductor around the stranded conductor 10, or the like manner. Moreover, the sheath 63 is prepared by winding a plastic tape around the outer conductor 62, extruding a molten plastic around the outer conductor 62 to cover the same, or the like manner.

According to the present invention, the cable 60 exhibiting good stranding workability and terminal processability as well as having good conductivity, tensile properties, flexing properties, and high-frequency properties are obtained. Accordingly, even if a cable according to the present invention is employed under such an atmosphere where an external force produced by combining severe flexing, twisting, stretching and the like with each other is repeatedly loaded as in a movable section of medical equipment, industrial robots, electronic equipment and the like, no breaking is happened so that such cable can be used for a long period of time.

EXAMPLES

Test 1

Example 1

Six element wires each made from soft copper having 95% IACS conductivity, 200 MPa tensile strength, and 15% elongation are stranded around the outer circumference of a single element made from a fiber-reinforced type Cu—5Ag alloy (wt %) having 1000 MPa tensile strength, 70% IACS conductivity, and 1% elongation to prepare a stranded conductor having the structure shown in FIG. 1.

Comparative Example 1

Seven element wires each made from soft copper having 220 MPa tensile strength, 95% IACS conductivity, and 20% elongation are stranded with each other to prepare a stranded conductor having the same structure as that of Example 1 wherein an inner layer and an outer layer of which are composed of all the same element wires.

Comparative Example 2

Seven element wires each made from Cu—Sn alloy having 800 MPa tensile strength, 70% IACS conductivity, and 2% elongation are stranded with each other to prepare a stranded conductor having the same structure as that of Example 1 wherein an inner layer and an outer layer of which are composed of all the same element wires.

Comparative Example 3

Seven element wires each made from fiber-reinforced type Cu—5Ag alloy (wt %) having 1100 MPa tensile strength, 70% IACS conductivity, and 2% elongation are stranded with each other to prepare a stranded conductor having the same structure as that of Example 1 wherein an inner layer and an outer layer of which are composed of all the same element wires.

With respect to the stranded conductors obtained in Example 1 as well as Comparative Examples 1 to 3, flex life (number of times), conductivity (% IACS) , and tensile strength (MPa) were determined and evaluated in addition to comparison in manufacturing cost wherein each value in comparison of manufacturing costs is represented by a relative value in the case where a manufacturing cost in Comparative Example 1 is considered to be 100. Results in respective evaluations as well as respective comparative results are shown in Table 1.

TABLE 1

| | Examples | | | |
|---|---|---|---|---|
| Items | Example 1 | Comparative Example 1 | Comparative Example 2 | Comparative Example 3 |
| Inner Layer Material | Fiber-Reinforced Type Cu-Ag Alloy | Soft Copper | Cu-Sn Alloy | Fiber-Reinforced Type Cu-Ag Alloy |
| Outer Layer Material | Soft Copper | Soft Copper | Cu-Sn Alloy | Fiber-Reinforced Type Cu-Ag Alloy |

TABLE 1-continued

| Items | Examples | | | |
|---|---|---|---|---|
| | Example 1 | Comparative Example 1 | Comparative Example 2 | Comparative Example 3 |
| Flex Life (Number of Times) | 1100 | 50 | 800 | 4000 |
| Conductivity (% IACS) | 90 | 95 | 70 | 70 |
| Tensile Strength (MPa) | 500 | 250 | 690 | 1100 |
| Comparison in Cost | 120 | 100 | 250 | 400 |

A stranded conductor prepared in Example 1 exhibited 1100 times flex life, 90% IACS conductivity, 500 MPa tensile strength, and 1.2 times higher manufacturing cost than that of Comparative Example 1, so that the stranded conductor of Example 1 was excellent in flexing resistance, conductivity, and tensile strength, besides a manufacturing cost was comparatively inexpensive.

On the other hand, although a stranded conductor prepared in Comparative Example 1 exhibited the lowest value of manufacturing cost in Examples and good conductivity (95% IACS) as compared with Example 1, flex life of which was very short (50 times) , besides tensile strength of which was also low (250 MPa).

Furthermore, although a stranded conductor prepared in Comparative Example 2 had about 40% higher tensile strength (690 MPa) than that of Example 1, flex life of which was short (800 times), besides conductivity of which was low (70% IACS), and a manufacturing cost of which was two or more times higher than that of Example 1.

Moreover, although a stranded conductor prepared in Comparative Example 3 exhibited longer flex life (4000 times) as well as higher tensile strength (1100 MPa) than those of Example 1, respectively, conductivity of which was lower (70% IACS), and a manufacturing cost of which was 3.3 times higher in comparison with those of Example 1, respectively.

Test 2

Example 2

A stranding operation is made with the use of the same respective element wires each having 0.04 mm outer diameter $\phi$ as those of Example 1 in such that a ratio of a stranding pitch $P_1$ in an outer layer to a layer core diameter $D_1$ in the outer layer ($P_1/D_1$) becomes 15 to prepare a stranded conductor having the same structure as that of Example 1.

Example 3

A stranded conductor is prepared in accordance with the same manner as that of Example 2 except that a ratio of a stranding pitch $P_1$ in an outer layer to a layer core diameter $D_1$ in the outer layer ($P_1/D_1$) is made to be 25.

Comparative Example 4

A stranded conductor is prepared in accordance with the same manner as that of Example 2 except that a ratio of a stranding pitch $P_1$ in an outer layer to a layer core diameter $D_1$ in the outer layer ($P_1/D_1$) is made to be 5.

Comparative Example 5

A stranded conductor is prepared in accordance with the same manner as that of Example 2 except that a ratio of a stranding pitch $P_1$ in an outer layer to a layer core diameter $D_1$ in the outer layer ($P_1/D_1$) is made to be 30.

With respect to the stranded conductors obtained in Examples 2 and 3 as well as Comparative Examples 4 and 5, flex life (number of times) was determined and evaluated, and terminal processability was evaluated in addition to comparison in manufacturing cost wherein each value in comparison of manufacturing costs is represented by a relative value in the case where a manufacturing cost in Comparative Example 5 is considered to be 100. Results in respective evaluations as well as respective comparative results are shown in Table 2 wherein good processability is represented by ○, while poor processability is represented by x.

TABLE 2

| Items | Examples | | | |
|---|---|---|---|---|
| | Example 2 | Example 3 | Comparative Example 4 | Comparative Example 5 |
| Pitch/Layer Core Diameter | 15 | 25 | 5 | 30 |
| Flex Life (Number of Times) | 1400 | 1250 | 1450 | 1000 |
| Terminal Processability | ○ | ○ | ○ | X (Appearance of Untwisted Strand) |
| Comparison in Cost | 120 | 110 | 180 | 100 |

Both of the stranded conductors of Examples 2 and 3 exhibited 1400 times and 1250 times flex life, respectively, both good terminal processability, both excellent flexing resistance as well as terminal processability, respectively, both manufacturing costs of which were 1.2 times and 1.1 times higher than that of Comparative Example 5, so that these manufacturing costs were comparatively inexpensive.

On the other hand, although a stranded conductor of Comparative Example 4 exhibited good flex life (1450 times) and good terminal processability, a manufacturing cost of which was 1.8 times higher that that of Comparative Example 5.

Moreover, although a stranded conductor of Comparative Example 5 exhibited the cheapest manufacturing cost in Examples as well as good flex life, terminal processability was poor, and untwisted strand (in element wires constituting the outer layer) was observed at the time when a terminal is processed.

Test 3

Example 4

A stranding operation is made with the use of the same respective element wires each having 0.04 mm outer diameter $\phi$ as those of Example 1 in such that Ag plating is applied on the outer circumference of each element wire so as to form 0.6 $\mu$m film thickness, and a ratio of a stranding pitch $P_1$ in an outer layer to a layer core diameter $D_1$ in the outer layer ($P_1/D_1$) becomes 15 to prepare a stranded conductor having the same structure as that of Example 1.

Example 5

A stranding conductor is prepared in accordance with the same manner as that of Example 4 except that a film thickness of Ag plating is made to be 1.0 $\mu$m.

Comparative Example 6

A stranding conductor is prepared in accordance with the same manner as that of Example 4 except that a film thickness of Ag plating is made to be 0.3 $\mu$m.

Comparative Example 7

A stranding conductor is prepared in accordance with the same manner as that of Example 4 except that hot Sn-dipping is applied to the outer circumference of each element wire so as to have 1.0 $\mu$m film thickness.

Comparative Example 8

A stranding conductor is prepared in accordance with the same manner as that of Example 4 except that Sn electroplating is applied to the outer circumference of each element wire so as to have 1.0 $\mu$m film thickness.

With respect to the stranded conductors obtained in Examples 4 and 5 as well as Comparative Examples 6 through 8, flex life (number of times) was determined and evaluated, and terminal processability was evaluated in addition to comparison in manufacturing cost wherein each value in comparison of manufacturing costs is represented by a relative value in the case where a manufacturing cost in Comparative Example 7 is considered to be 100. Results in respective evaluations as well as respective comparative results are shown in Table 3 wherein particularly good processability is represented by , and good processability is represented by ○.

TABLE 3

| Items | Examples | | | | |
|---|---|---|---|---|---|
| | Example 4 | Example 5 | Comparative Example 6 | Comparative Example 7 | Comparative Example 8 |
| Plating Material | Ag Plating | Ag Plating | Ag Plating | Hot Sn-Plating | Sn Electro plating |
| Plating Film Thickness ($\mu$m) | 0.6 | 1.0 | 0.3 | 1.0 | 1.0 |
| FlexLife (Number of Times) | 1800 | 1700 | 1600 | 1500 | 1400 |
| Terminal Processability | ◎ | ◎ | ○ | ○ | ○ |
| Comparison in Cost | 110 | 120 | 110 | 100 | 105 |

All the stranded conductors of Comparative Examples 6 through 8 exhibited good flex life (1600, 1500, and 1400 times) as well as good terminal processability (all of them were evaluated by ○), and manufacturing costs of them were inexpensive.

On one hand, stranded conductors of Examples 4 and 5 exhibited better flex life (1800, and 1700 times) and better terminal processability (all of them were evaluated by ) than those of Comparative Examples 6 through 8. Furthermore, manufacturing costs of Examples 4 and 5 were somewhat expensive than that of Comparative Examples 6 through 8, and thus, they were comparatively inexpensive.

As mentioned above, it could be confirmed from the results in the Tests 1 to 3 that the stranded conductors of Examples 1 through 5 according to the present invention exhibited the same degree of conductivity as that of a soft copper wire, besides good flex life as well as tensile strength, and could be prepared inexpensively.

Embodiments of the present invention are not limited to those mentioned above, but they may be a variety of modifications other those described above, as a matter of course.

In brief, the following excellent advantages are achieved in accordance with the present invention.

(1) In a stranded conductor to be used for movable member, when second element wires each having high elongation are disposed for an outer layer section having the highest amount of strain, and a first element wire(s) is (are) arranged for an inner layer section to which the highest tensile stress is to be loaded, good tensile properties are obtained, besides a remarkable improvement in flexing properties can be intended.

(2) In the above paragraph (1), since the second element wires constituting the outer layer section exhibit high conductivity, high-frequency properties of the resulting stranded conductor become good.

(3) When the stranded conductor to be used for movable member in the paragraphs (1) and (2) is used for a cable conductor, such a cable having good conductivity, good tensile properties, good flexing properties, and good high-frequency properties can be obtained.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A stranded conductor to be used for movable member prepared by stranding two or more types of element wires with each other, each type having different mechanical properties from one another, and having a two-layered structure of an inner layer section and an outer layer section, comprising:

a first element wire constituting at least the inner layer section having 1.5 times or higher tensile strength than that of a second element wire constituting at least a part of the outer layer section; and the two or more types of element wires being stranded with each other such that a ratio of a strength in a group of inner layer element wires forming the inner layer section to a strength in a group of outer layer element wires forming the outer layer section (a tensile strength in the group of inner layer element wires/a tensile strength in the group of outer layer element wires) comes to be 0.5 to 5;

wherein each outer diameter of said first and second element wires is formed to be 0.08 mm or thinner and the outer diameter of each of the element wires constituting said group of the outer layer element wires is made to be smaller than that of each of the element wires constituting said group of the inner layer element wires, and an Ag plating film having 0.6 $\mu$m or thicker film thickness is formed around the outer circumference of said two or more types of element wires including said first and second element wires.

2. A stranded conductor to be used for movable member as claimed in claim 1, wherein:

said two or more types of element wires are stranded with each other such that a ratio of a stranding pitch in said outer layer section to a layer core diameter comes to be 7 to 25.

3. A stranded conductor to be used for movable member as claimed in claim 1, wherein:

said rigid copper alloy wires are prepared from a fiber-reinforced type copper alloy containing 2 to 10 wt % of Ag or Nb, and said soft or semi-rigid copper alloy wires are prepared from copper or an Sn-containing copper alloy wherein a sum total of additives is 0.5 wt % or less.

4. A cable using a stranded conductor to be used for movable member, comprising:

an insulating layer being disposed around the outer circumference of said stranded conductor to be used for movable member as claimed in claim 1.

5. A cable using a stranded conductor to be used for movable member as claimed in claim 4, wherein:

an outer conductor layer is disposed around the outer circumference of said insulating layer.

6. A stranded conductor to be used for movable member prepared by stranding two or more types of element wires with each other, each type having different mechanical properties from one another, and having a two-layered structure of an inner layer section and an outer layer section, comprising:

a first element wire made from a rigid copper alloy wire having 1000 MPa or higher tensile strength and 0.2% or higher elongation, which constitutes at least a part of the inner layer section;

a second element wire made from a soft or a semi-rigid copper alloy wire having 70% or higher IACS and 5% or higher elongation, which constitutes at least a part of the outer layer section; and the two or more types of element wires being stranded with each other such that a ratio of a strength in a group of inner layer element wires forming the inner layer section to a strength in a group of outer layer element wires forming the outer layer section (a tensile strength in the group of inner layer element wires/a tensile strength in the group of outer layer element wires) comes to be 0.5 to 5;

wherein each outer diameter of said first and second element wires is formed to be 0.08 mm or thinner and the outer diameter of each of the element wires constituting said group of the outer layer element wires is made to be smaller than that of each of the element wires constituting said group of the inner layer element wires, and an Ag plating film having 0.6 $\mu$m or thicker is formed around the outer circumference of said two or more types of element wires including said first and second element wires.

7. A stranded conductor to be used for movable member as claimed in claim 6, wherein:

said two or more types of element wires are stranded with each other such that a ratio of a stranding pitch in said outer layer section to a layer core diameter comes to be 7 to 25.

8. A stranded conductor to be used for movable member as claimed in claim 6, wherein:

said rigid copper alloy wires are prepared from a fiber-reinforced type copper alloy containing 2 to 10 wt % of Ag or Nb, and said soft or semi-rigid copper alloy wires are prepared from copper or an Sn-containing copper alloy wherein a sum total of additives is 0.5 wt % or less.

9. A cable using a stranded conductor to be used for movable member, comprising:

an insulating layer being disposed around the outer circumference of said stranded conductor to be used for movable member as claimed in claim 6.

10. A cable using a stranded conductor to be used for movable member as claimed in claim 9, wherein:

an outer conductor layer is disposed around the outer circumference of said insulating layer.

11. A layered stranded conductor, comprising:

an inner layer section having one or more inner section element wires, including a first element wire with an outer diameter of 0.08 mm or less; and an outer layer section stranded to the inner layer section, and having one or more outer section element wires, including a second element wire with an outer diameter of 0.08 mm or less that is stranded with the first element wire;

wherein (i) the first element wire has 1.5 times or higher tensile strength than that of the second element wire, and (ii) the stranded one or more inner and one or more outer section element wires have a ratio of a strength of the one or more inner section element wires to a strength of the one or more outer section element wires of 0.5 to 5, wherein the outer diameter of each of the one or more outer section element wires is smaller than the outer diameter of each of the one or more inner section element wires; and an Ag plating film having 0.6 $\mu$m or thicker film thickness is formed around the outer circumference of each of the one or more outer section element wires and each of the one or more inner section element wires.

12. The layered stranded conductor as claimed in claims 11, wherein:

the first element wire is formed of a rigid copper alloy wire having 1000 MPa or higher tensile strength and 0.2% or higher elongation; and the second element wire is formed of a soft or a semi-rigid copper alloy wire having 70% or higher IAGS and 5% or higher elongation.

13. The layered stranded conductor as claimed in claim 11, further comprising:

an insulating layer disposed around the stranded one or more inner and one or more outer section element wires.

14. The layered stranded conductor as claimed in claim 13, further comprising:

an outer conductor layer disposed around the insulating layer.

15. A layered stranded conductor, comprising:

an inner layer section having multiple inner section element wires including a first element wire; and an outer layer section stranded to the inner layer section, and having one or more outer section element wires, including a second element wire that is stranded with the first element wire; wherein (i) the first element wire have has 1.5 times or higher tensile strength than that of the second element wire, and (ii) the stranded multiple inner and one or more outer section element wires have ratio of a strength of the multiple inner section element wires to strength of the one or more outer section element wires of 0.5 to 5; and wherein the first and the second element wires have an outer diameter of 0.08 mm or less.

wherein the outer diameter of each of the one or more outer section element wires is smaller than the outer diameter of each of the one or more inner section element wires: and an AQ plating film having 0.6 $\mu$m or thicker film thickness is formed around the outer circumference of each of the one or more outer section element wires and each of the one or more inner section element wires.

16. A layered stranded conductor, comprising: wherein:

an inner layer section having multiple inner section element wires, including a first element wire formed of a rigid copper alloy wire having 1000 Mpa or higher tensile strength and 0.2% or higher elongation; and an outer layer section stranded to the inner layer section, and having one or more outer section element wires, including a second element wire that is stranded with the first element wire and is formed of a soft or a semi-rigid copper alloy wire having 70% or higher lAGS and 5% or higher elongation;

wherein the stranded multiple inner and one or more outer section element wires have a ratio of a strength of the multiple inner section element wires to a strength of the one or more outer section element wires of 0.5 to 5; and wherein the first and the second element wires have an outer diameter of 0.08 mm or less, wherein the outer diameter of each of the one or more outer section element wires is smaller than the outer diameter of each of the one or more inner section element wires: and an AQ plating film having 0.6 $\mu$m or thicker film thickness is formed around the outer circumference of each of the one or more outer section element wires and each of the one or more inner section element wires.

* * * * *